United States Patent [19]

Best

[11] 4,345,498

[45] Aug. 24, 1982

[54] FOOD SLICING MACHINE

[75] Inventor: Gary R. Best, Jackson County, Mo.

[73] Assignee: Rival Manufacturing Company, Kansas City, Mo.

[21] Appl. No.: 160,660

[22] Filed: Jun. 18, 1980

[51] Int. Cl.[3] ..... B26D 7/06

[52] U.S. Cl. ..... 83/707; 83/701; 312/258; 312/260

[58] Field of Search ..... 83/701, 703, 707, 713, 83/714, 719, 730; 312/258, 260, 261

[56] References Cited

U.S. PATENT DOCUMENTS

| | | | |
|---|---|---|---|
| 3,872,761 | 3/1975 | Gutowski et al. | 83/767 |
| 4,070,941 | 1/1978 | Lorenz | 83/701 X |
| 4,246,821 | 1/1981 | Fuse | 83/707 |
| 4,273,013 | 6/1981 | Artin et al. | 83/707 X |

FOREIGN PATENT DOCUMENTS 2338523 2/1975 Fed. Rep. of Germany .

OTHER PUBLICATIONS

"Electric Food Slicer From General Electric Use And Care Book" Pub. No. 57C131189.

*Primary Examiner*—Frank T. Yost
*Assistant Examiner*—Robert P. Olszewski
*Attorney, Agent, or Firm*—Hume, Clement, Brinks, William & Olds, Ltd.

[57] ABSTRACT

A food slicing machine which folds up into a compact storage position includes a motor driven blade mounted on an upright housing. A platform pivotally mounted to the housing supports a sliding food tray which in turn receives a food pusher used to maintain the food against a guide surface during the slicing stroke. A thumb guard pivotally connected with the food tray must be positioned properly to permit operation of the machine. The components are removable for cleaning and are contained together when the unit is folded up for storage.

30 Claims, 8 Drawing Figures

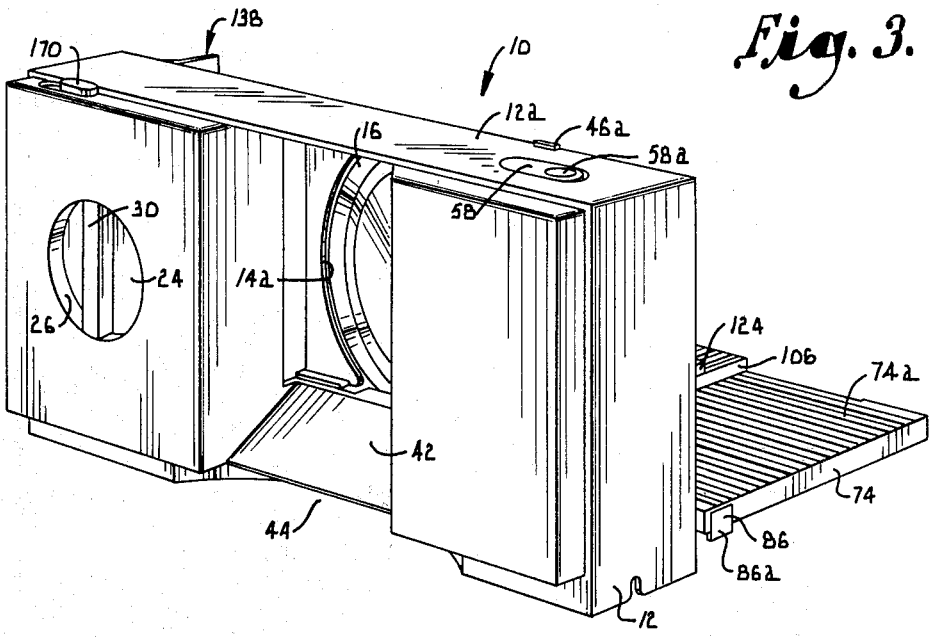
Fig. 3.
Fig. 4.
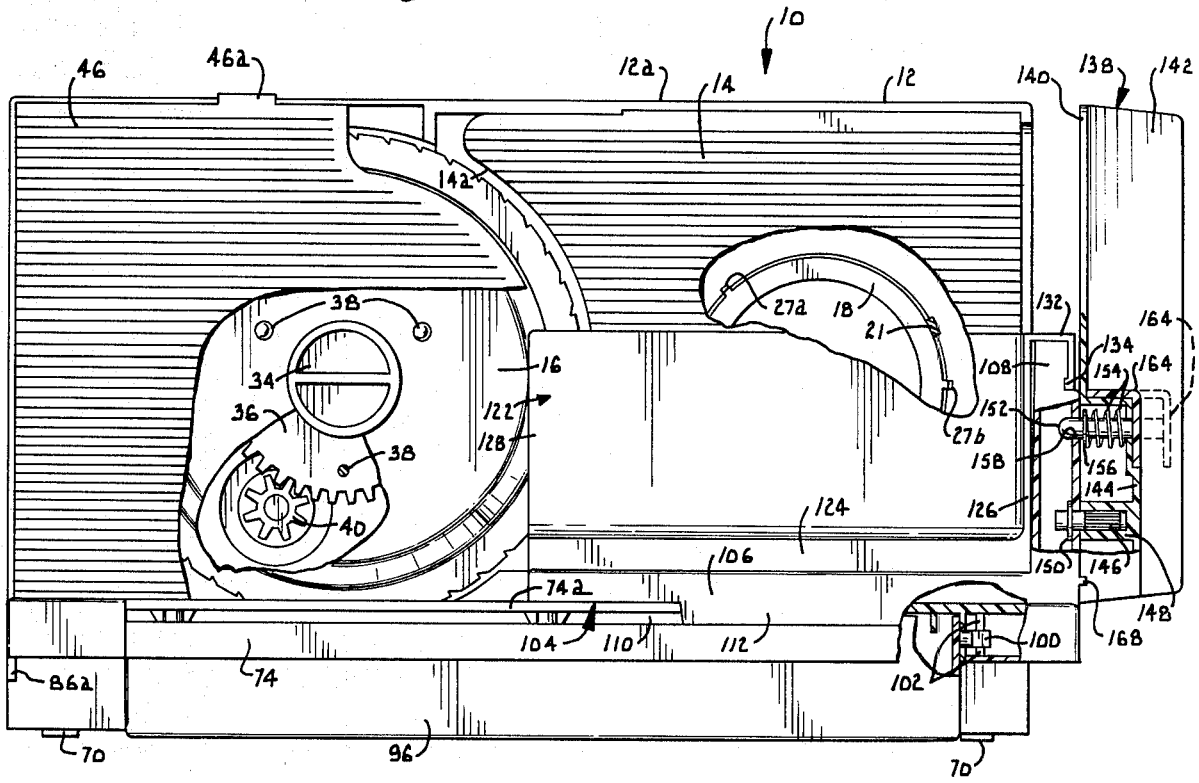

Fig. 5.
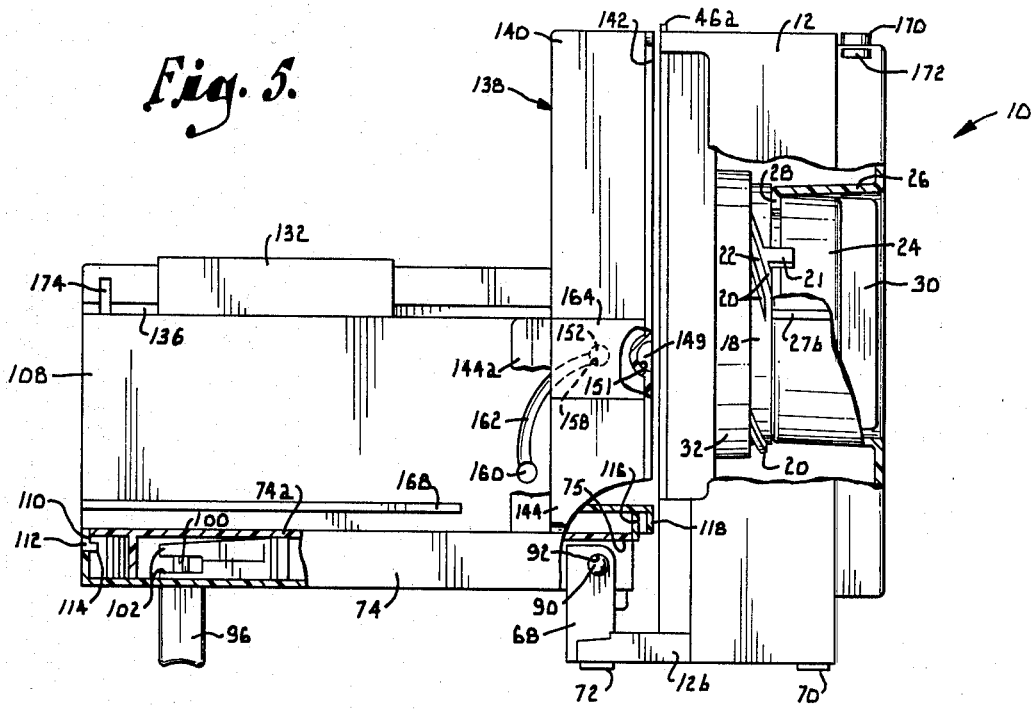
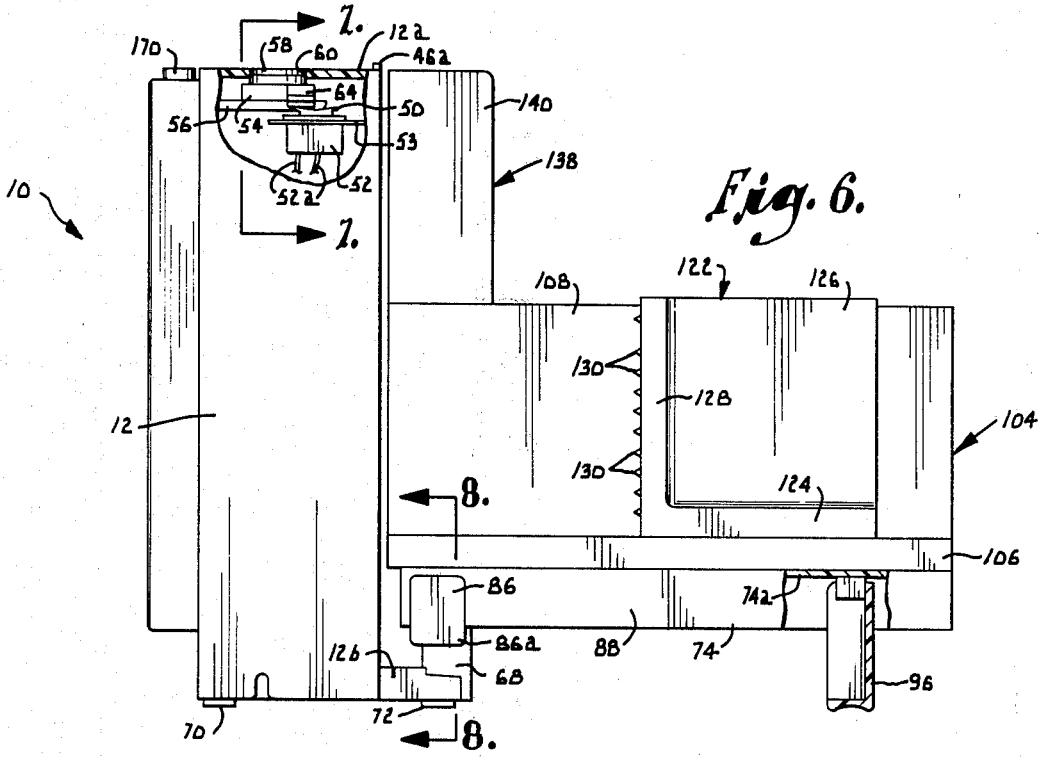
Fig. 7.
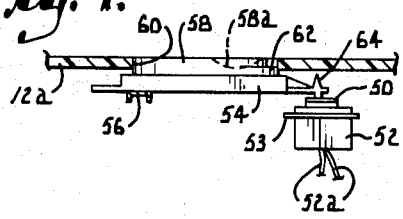
Fig. 8.
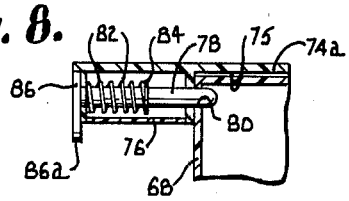

FOOD SLICING MACHINE

BACKGROUND AND SUMMARY OF THE INVENTION

This invention relates generally to kitchen appliances more particularly to an improved food slicing machine for household use.

Although food slicers have proven to be useful kitchen appliances, existing units have not been wholly without problems. Convenient storage of the food slicer when not in use has posed a particularly serious problem. Even though food slicers have been constructed so as to fold up in order to minimize their storage space, such devices have the disadvantage that all of the components are not contained together in the folded up unit. Consequently, parts such as food trays and food clamps often become separated or lost. Additionally, the unit is not locked securely in the folded condition and can inadvertently unfold. Disassembly of existing food slicers for cleaning also presents difficulties in that complicated latches and the like must be manipulated to permit removal of the components from the main housing portion of the machine.

Some of the food slicers that are currently available are lacking somewhat in safety. Even though the slicing blade is ordinarily covered by a blade guard, there is still a risk that the hands of the user may inadvertently slip against the blade and cause severe injury to the fingers or thumb. In addition, the machine is sometimes operated without all the components in the proper position, and this increases the possibility of the hands slipping into the blade area. Some food slicers tend to produce uneven slices of food, especially when large items are being sliced, due to their failure to prevent the food from skewing relative to the blade during the slicing stroke.

The present invention has, as its primary object, the provision of an improved food slicing machine which may be folded up into a compact storage condition with all of the components stored together in the folded up unit. Consequently, the parts are not as likely to become lost or separated as they are in existing machines which store parts such as food trays and food clamps separately from the main unit.

This is accomplished by providing a food slicing machine having a housing which rests upon a support surface and defines along one side a generally vertical guide surface. A slicing blade is mounted on the housing adjacent the guide surface, and is operable to slice food directed against the blade. Coupled to the housing is a platform which may be pivoted between a generally vertical storage position and a generally horizontal operating position. A food tray is mounted on the platform and moves toward and away from the slicing blade. The food tray includes a food table which carries food toward the slicing blade, and a food pusher projecting upward from the food table to push the food toward the slicing blade. When the platform is in the storage position, the table portion is disposed between the platform and the guide surface and the food pusher is located adjacent and end of the housing.

Another object of the invention is to provide a food slicing machine of the character described which may be quickly and easily folded up for storage and unfolded for use.

Still another object of the invention is to provide, in a food slicing machine of the character described, a simple yet effective lock mechanism for locking the parts in the folded storage position.

A further object of the invention is to provide a food slicing machine of the character described which may be quickly and easily disassembled for cleaning of the parts and reassembled after cleaning. It is important in this regard that components such as the platform, food tray and food pusher may be easily removed for cleaning and yet are securely maintained in their proper operating positions during use of the machine.

An additional object of the invention is to provide, in a food slicing machine of the character described, a thumb guard which prevents the fingers and thumb of the user from slipping into the blade area during operation of the machine. With respect to safety, it is still another important feature of the invention that the machine cannot be operated unless all of the components, including the thumb guard, are in the proper position.

Yet another object of the invention is to provide a food slicing machine of the character described which is capable of slicing a wide variety of foods into uniform slices which may be varied in their thickness. Foods such as ham, roasts and other meats, cheeses, breads, fruits, vegetables and the like may be sliced by the machine, and the thickness of the slices is accurately controlled by a guide surface which is readily adjustable in position.

A still further object of the invention is to provide a food slicing machine of the character described which is constructed simply and economically and which operates efficiently.

Other and further objects of the invention, together with the features of novelty appurtenant thereto, will appear in the course of the following description.

DETAILED DESCRIPTION OF THE INVENTION

In the accompanying drawings which form a part of the specification and are to be read in conjunction therewith and in which like reference numerals are used to indicate like parts in the various views:

FIG. 3 is a perspective view of the food slicing machine in its unfolded condition taken from the back side of the machine;

FIG. 4 is a front elevational view of the food slicing machine in its unfolded condition, with portions broken away for purposes of illustration;

FIG. 5 is an end elevational view of the food slicing machine in its unfolded condition taken from the right end as viewed in FIG. 4, with portions broken away for purposes of illustration;

FIG. 6 is an end elevational view of the food slicer in its unfolded condition taken from the left end as viewed in FIG. 4, with portions broken away for purposes of illustration;

FIG. 7 is a fragmentary sectional view on an enlarged scale taken generally along line 7—7 of FIG. 6 in the direction of the arrows; and FIG. 8 is a fragmentary sectional view on an enlarged scale taken generally along line 8—8 of FIG. 6 in the direction of the arrows.

Figure 1:
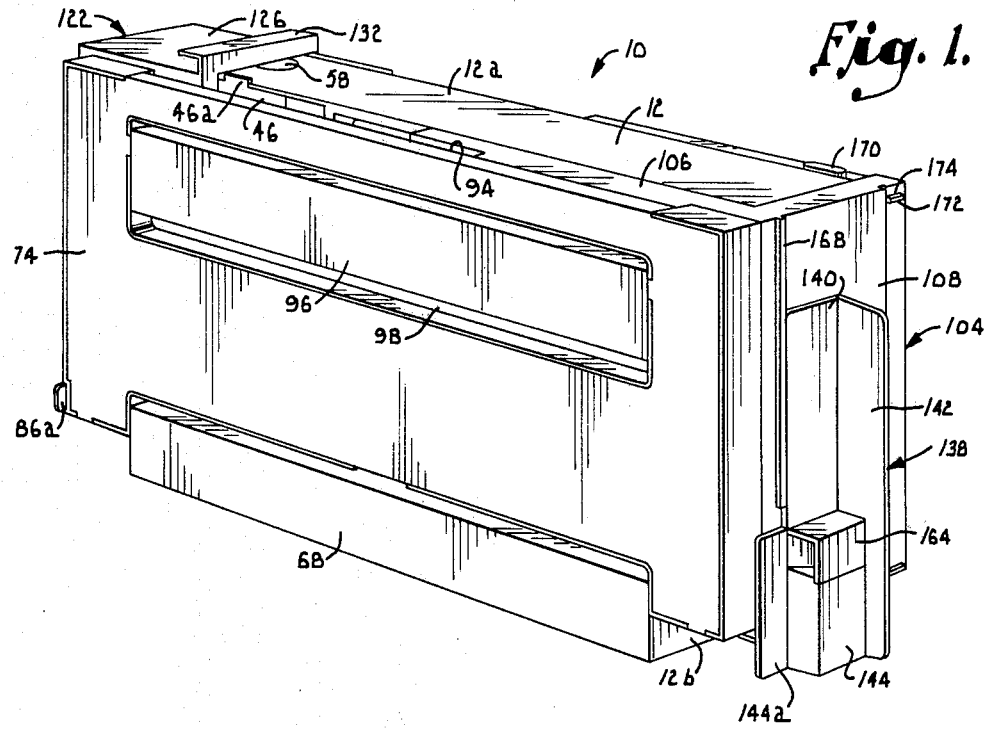
FIG. 1 is a perspective view of a food slicing machine constructed according to a preferred embodiment of the present invention, with the machine folded up in its storage position.

Referring now to the drawings in detail, reference numeral 10 generally designates a food slicing machine constructed in accordance with a preferred embodiment of the present invention. The machine 10 includes an upright housing 12 having a generally rectangular, box-like shape. The front side of housing 12 presents on the right hand portion thereof a movable guide surface 14 which is used to guide food toward a slicing blade 16 mounted for rotation on the left side of the front surface of the housing. Guide surface 14 is ribbed and is oriented generally vertically for guiding of the food toward blade 16.

A screw mechanism is provided to adjust the position of surface 14 with respect to blade 16 in order to adjust the thickness of the slices of food which are cut by the blade. As best shown in FIG. 5, the screw mechanism includes a cam ring 18 having spiral ribs 20 on its outside surface. A tab 21 projects to the rear from one of the ribs 20. A spiral groove 22 is presented between each pair of ribs 20. Ring 18 is carried on the front end of a cylinder 24 which is supported for rotation within a similarly shaped cylinder 26 forming part of housing 12. A pair of spaced apart ribs 27*a* and 27*b* are formed on the outside surface of cylinder 26 (See FIGS. 4 and 5) to serve as stops which engage tab 21 to limit rotation of cam ring 18. Cylinder 26 forms a recess in the back side of the housing and includes an in-turned flange 28 on its forward end. Flange 28 fits in an annular groove formed between cam ring 18 and cylinder 24 in order to maintain the cylinder and cam ring in position on the housing. Connected with the back end of cylinder 24 is a handle 30 which is accessible from the back of the housing in order to effect turning of cylinder 24 and the cam ring 18. It is noted that cylinder 24 and handle 30 are recessed forwardly of the back surface of housing 12 within cylinder 26.

A second cam ring 32 is fitted around the forward end of cam ring 18 and is provided with a plurality of spiral ribs (not shown) on its inside surface which fit in the spiral grooves 22 formed on cam ring 18. Guide surface 14 is carried on the forward end of cam ring 32. When handle 30 is turned to effect turning of cam ring 18, the spiral ribs 20 act against the mating spiral ribs (not shown) on ring 32 in camming fashion in order to move guide surface 14 forwardly and rearwardly while at all times maintaining the guide surface in a vertical orientation. The distance of guide surface 14 to the rear of slicing blade 16 can thus be varied in order to vary the thickness of the slices of food.

When cam ring 18 is turned clockwise (as viewed in FIG. 4) far enough that tab 21 contacts rib 27*b*, the spiral ribs on ring 32 move out of grooves 22 to release guide surface 14 and the connected structure from the housing for cleaning and other purposes. Reinstallation of the guide surface structure can be effected simply by fitting ring 32 around ring 18 and turning ring 18 counterclockwise such that the grooves 22 receive the spiral ribs on ring 32. The engagement of tab 21 against rib 27*b* provides a positive stop mechanism that maintains cam ring 18 in the proper rotative position to receive ring 32 during reinstallation. Engagement of tab 21 with rib 27*a* limits counterclockwise rotation of ring 18 and thus prevents excessive turning of the ring and the possible over torque or other damage that could occur to the spiral ribs due to such excessive turning of the cam ring.

With reference now to FIG. 4 in particular, blade 16 is circular and is serrated on its sharp peripheral edge. The blade is mounted on housing 12 for rotation about its center, and it may be removed for cleaning by turning a central hub 34 which releases from the housing in order to permit removal of the slicing blade. A large gear 36 is secured to the back side of blade 16 by rivets 38. Gear 36 is driven by a smaller gear 40 which is in turn driven by a conventional electric motor (not shown) mounted within housing 12. The edge of blade 16 is spaced closely from an arcuate left edge 14*a* of guide surface 14, and housing 12 is open in the area between edge 14*a* and the blade edge in order to permit the slices of food to pass behind the slicing blade. As shown in FIG. 3, a downwardly sloping surface 42 is formed on housing 12 immediately behind and below the opening between edge 14*a* and the edge of blade 16. A food plate (not shown) may be fitted into an opening 44 formed below surface 42, and the food plate is thus able to receive the slices of food which are formed by slicing blade 16. Juices and other materials resulting from the slicing operation are also directed downwardly along surface 42 and onto the food plate (not shown).

The front surface of blade 16 is covered by a removable blade guard 46. The blade guard is mounted to housing 12 by means of lugs (not shown) which project from the blade guard into openings (also not shown) formed in the housing. A small tube 46*a* projects upwardly from the top edge of blade guard 46 and may be gripped by the fingers to facilitate removal of the blade guard for cleaning and to provide access to blade 16.

The electric motor (not shown) which drives blade 16 through the gears 40 and 36 is controlled by a switch mechanism best shown in FIGS. 6 and 7. A plunger 50 projects upwardly out of a switch box 52 mounted on a bracket 53 supported within housing 12 below its top panel 12*a*. When plunger 50 is depressed, the electric motor is energized through suitable wiring 52*a*, while release of the plunger effects de-energization of the motor to stop rotation of blade 16. Depression and release of plunger 50 is effected by a switch actuator 54 which is mounted on a frame member 56 secured to the housing. Actuator 54 has a button portion 58 which projects upwardly through an opening 60 formed in the top housing panel 12*a*. A curved depression or recess 58*a* is formed in the top surface of button 58 and is large enough to conveniently receive the finger or thumb of the user of the food slicer. One end of button 58 has a shoulder portion 62 which, upon depression of the button in the area of depression 58*a*, can be pressed below the top panel 12*a* of housing 12. Actuator 54 may be slid far enough that shoulder 62 catches against the underside of panel 12*a* adjacent the opening 60. When this occurs, a projecting arm portion 64 of the switch actuator is pressed downwardly against plunger 50 in order to maintain the plunger in a depressed condition, thereby maintaining the electric motor in its energized condition. The plunger is released when button 58 is slid in an opposite direction far enough to permit shoulder 62 to enter opening 60 so that the spring associated with the plunger can extend the plunger upwardly to deenergize the motor.

Referring particularly to FIGS. 5 and 6 the bottom portion of housing 12 has a base 12*b* which projects forwardly and connects with a support leg 68 at its forward end. A pair of pads 70 are located on the underside of housing 12, and another pair of pads 72 are mounted to base 12*b* immediately below the support leg 68. Housing 12 is adapted to rest on a counter top or table with pads 70 and 72 in contact with the supporting surface. A cord (not shown) for supplying electric current to the drive motor may be stored within a storage compartment located at the bottom portion of housing 12.

Figure 2:
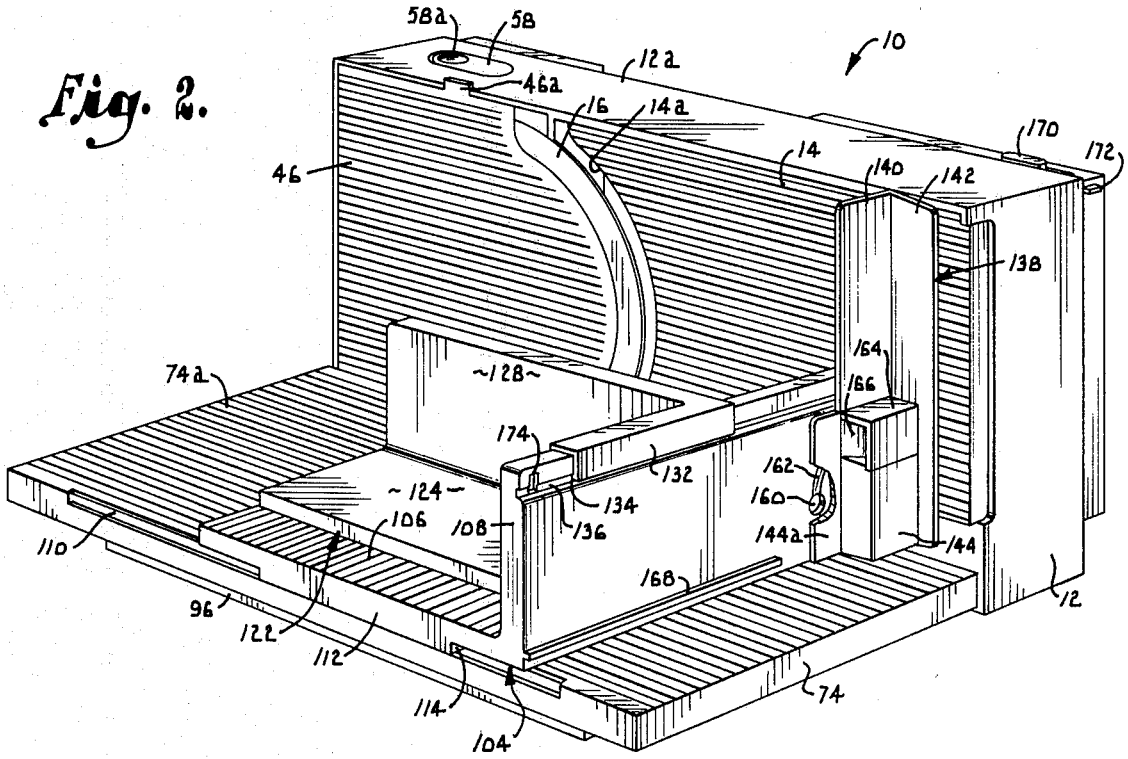
FIG. 2 is a perspective view of the food slicing machine shown in FIG. 1, with the machine unfolded to its operating position.

A rectangular platform 74 is mounted to housing 12 for pivotal movement between the folded storage position shown in FIG. 1 and the unfolded operating position shown in FIG. 2. Platform 74 is a hollow member having a top panel 74*a* presenting a ribbed upper surface. The underside of platform 74 is recessed below panel 74*a* along its back edge in order to receive the top portion of leg 68 in the recess indicated by numeral 75. As shown in FIG. 8, hollow box portions 76 are formed on platform 74 at oppposite ends of the recess 75. Mounted in the left box 76 is a pin 78 which projects out of the box and through an opening 80 formed in the left end of leg 68 near the top thereof. Pin 78 is biased inwardly in a direction to remain in opening 80 by a compression spring 82 which engages the outside of box 76 at one end and a collar 84 formed on pin 78 at the other end.

A small plate 86 is connected with the outer end of pin 78 and serves as a knob which is used to withdraw the pin from opening 80 to permit removal of platform 74 from housing 12. Plate 86 has a flush fit with the adjacent side 88 of platform 74 (see FIG. 6). The lower end portion 86*a* of plate 86 projects below the side 88 of the platform and thus provides a downwardly projecting tab which may be gripped with the fingers to pull the plate outwardly against the force of spring 82, thus removing pin 78 from opening 80. The portion of pin 78 between collar 84 and plate 86 is preferably square in section and fits through a square opening the platform side 88.

Referring now to FIG. 5, a pin 90 projects outwardly from the right end of leg 68 or the end opposite the end in which opening 80 is formed. Pin 90 is received in an opening 92 formed in platform 74. Pins 78 and 90 are coaxial and cooperate to provide a horizontal pivot axis about which platform 74 may be pivoted between the operating and storage positions. Since leg 68 is spaced well forwardly of the front side of housing 12, the top platform panel 74*a* is spaced forwardly from the front side of housing 12 to present a space 94 (see FIG. 1) between the platform and housing in the storage position. Removal of platform 74 from the housing for cleaning can be accomplished by pulling plate 86 outwardly to withdraw pin 78 from opening 80 and then pulling the end of the platform forwardly to permit separation of pin 90 from opening 92. The platform can be replaced by reversing this procedure.

A front support leg 96 is mounted within a rectangular recess 98 formed below panel 74*a* in the underside of platform 74 near its forward edge. The opposite ends of leg 96 have projecting pins 100 (See FIGS. 4 and 5) which project into the hollow interior of platform 74 at opposite ends of recess 98. At least a portion of each pin 100 is square in section. The square portion of each pin 100 fits closely between a pair of arms 102 which are mounted within platform 74. The flat surfaces of the square pins 100 engage the flat edges of arms 102 to provide a detent effect which maintains leg 96 in the vertical position shown in FIG. 5. In this position, the bottom of the leg rests on a counter top to assist in supporting platform 74 in a horizontal position. Leg 96 can be pivoted ninety degrees (90°) to the storage position shown in FIG. 1 wherein the leg is contained wholly within recess 98. Again the flat sides of the square pins 100 engage the edges of arms 102 in a manner to maintain the leg in the stored position. The forward ends of arms 102 are able to be spread apart sufficiently to permit leg 96 to pivot between the storage and operating positions.

Reference numeral 104 generally designates a food tray which is mounted on platform 74 for sliding movement along the upper surface of the platform top panel 74*a*. The food tray 104 includes a horizontal table portion 106 and a vertical pusher plate 108 which serves to push food on table 106 toward the slicing blade 16. Plate 108 extends upwardly at a right angle from the right edge of table portion 106. The upper surface of table 106 is a ribbed surface on which the food is carried toward blade 16.

As best shown in FIGS. 2 and 5, a groove or slot 110 is formed along the front edge of platform 74 immediately below the top panel 74*a* of the platform. The front edge of table portion 106 of the food tray has a downwardly projecting flange 112 which terminates in an inturned lip 114 on its lower edge. Lip 114 fits closely in slot 110 and rides therein as food tray 104 is pushed along platform 74 during slicing strokes of the machine. The fit of lip 114 in slot 110 assures from the food tray is maintained properly on the upper surface of the platform during slicing strokes. The opposite or rearward edge portion of table 106 is provided with a downturned flange 116 (FIG. 5) which fits closely against the back edge of the upper panel 74*a* of platform 74 to assist in guiding the food tray as it is pushed along the platform. Another flange 118 projects downwardly along the back edge of the food tray at a location spaced from flange 116. The food tray 104 can be removed from platform 74 by lifting its back portion sufficiently to clear flange 116 above the platform. The food tray can then simply be pulled forwardly to withdraw lip 114 from slot 110 so that the food tray can be cleaned separately from the remainder of the unit. Replacement of tray 104 on the platform is accomplished by inserting lip 114 in slot 110 and dropping the back edge of the food tray to position flange 116 against the back edge of panel 74*a*.

A food grip or food pusher 122 is mounted on food tray 104 for movement thereon toward and away from the guide surface 14. The food pusher 122 includes a horizontal bottom panel 124, a vertical side panel 126, and a vertical plate portion 128 which serves to push food against guide surface 14 during operation of the machine. The surface of plate 128 which faces toward guide surface 14 is provided with a plurality of small spikes 130 which engage the food placed on the table portion of food tray 104.

As best shown in FIGS. 2 and 4, the upper edge of side panel 126 is provided with a channel 132 which is open at the bottom and which fits over the top edge of pusher plate 108 of the food tray. An inturned bead or lip 134 is formed on the lower edge of the outer leg of channel 132 and fits closely in a horizontal slot 136 which is formed along the outer surface of plate 108 at a location below its upper edge. The fit of lip 134 in slot 136 maintains food pusher 122 on food table 104 and guides the food pusher along a path carrying it toward and away from guide surface 14. With the food pusher 122 properly in place, its bottom panel 124 is located immediately on top of table portion 106 of the food tray.

Food pusher 122 can be removed from the food tray by sliding it outwardly far enough to completely remove lip 134 from groove 136. The food pusher can then be cleaned or otherwise handled separately from the remainder of the unit.

A thumb guard 138 is pivotally mounted on the outside surface of plate portion 108 of the food tray. The thumb guard 138 is in the form of an angle member having one flange 140 adjacent the outside surface of plate 108 and another flange 142 adjacent guide surface 14 in the operating position of the thumb guard. A generally rectangular box 144 is formed at the bottom end of thumb guard 138 and has a flange 144*a* which extends past the outer edge of flange 140 to engage platform 74 and thereby prevent food tray 104 from being moved along the platform when thumb guard 138 is in the storage position. A pivot pin 146 (FIG. 4) is extended through the outer panel of plate portion 108 and into an opening formed in a boss 148 formed internally of box 144. A retainer washer 150 retains the pivot pin 146 in place. Thumb guard 138 is thus pivotally mounted to plate 108 for movement about the horizontal axis of pin 146 between the upright operating position shown in FIG. 2 and the storage position shown in FIG. 1. In the storage position, flange 140 of the thumb guard extends along the outer surface of plate 108 and is oriented generally parallel to the top surface of platform 74. When thumb guard 138 is in the storage position, the end of box 144 projects well beyond the back end of plate portion 108 of the food tray and flange 144*a* projects beyond the side edge of platform 74. Consequenly, the end of box 144 engages the end of housing 12 to prevent movement of food tray 104 toward blade 116 unless the thumb guard is moved to its upright operating position (FIG. 2). In the operating position, a small boss 149 (FIG. 5) which is formed on plate 108 registers with a notch 151 formed in thumb guard 138.

Referring now to FIG. 4 in particular, box 144 contains a spring loaded locking pin 152 which is continuously urged inwardly by a compression spring 154 having its outer end engaged against the outer side of box 144 and its inner end engaged by a collar 156 which is snapped on pin 152. A first opening 158 is formed in plate 108 at a location to receive the inner end of pin 152 when thumb guard 138 is moved to the operating position. A second opening 160 (FIG. 2) is formed in plate 108 at a location to receive the end of pin 152 when thumb guard 138 is in the storage position. An arcuate groove 162 is formed in the outside surface of plate 108 in extension between openings 158 and 160. Spring 154 biases pin 152 inwardly, causing it to enter opening 158 in the operating position and opening 160 in the storage position. Consequently, the thumb guard is automatically locked in the operating position when it is moved thereto and in the storage position when it is moved thereto.

A knob 164 is mounted on the outer end of pin 152 and may be gripped with the fingers in order to pull pin 152 outwardly to withdraw it from openings 158 and 160. Thumb guard 138 can then be moved between the operating and storage positions with the rounded end of pin 152 traveling in the arcuate groove 162. Knob 164 is mounted immediately above box 144 and has an outer portion which is flush with the outer surface of the box. A recessed portion 166 (FIG. 2) of box 144 permits the fingers to be easily applied to knob 164 in order to facilitate gripping of the knob for pulling of the locking pin 152 out of openings 158 and 160. A horizontal rib 168 projecting from the outer surface of plate 108 acts as a stop against box 144 to prevent movement of thumb guard 138 beyond the operating position. As shown in FIG. 1, rib 168 engages the edge of flange 140 to prevent thumb guard 138 from being pivoted beyond the storage position.

In use, the food slicing machine 10 is set up in the operating position shown in FIG. 2. Platform 74 is in its unfolded horizontal position, and leg 96 is unfolded to assist in supporting the platform in a horizontal position spaced above the table or countertop on which the unit rests. The food tray 104 is installed on platform 74 and food pusher 122 is positioned on the food tray. Thumb guard 138 is in its vertical operating position wherein flange 142 is adjacent the front side of housing 12. The food which is to be sliced is placed on table portion 106 of the food tray with the end of the food to be sliced positioned against guide surface 14 and panel 128 of the food pusher positioned against the opposite end of the food. Button 58 is depressed and shoulder 62 is slid beneath the top panel 12*a* of the housing such that plunger 50 is depressed to energize the electric motor (not shown) which effects rotation of the slicing blade 16. Since the thickness of the slices which are to be made depends upon the distance of guide surface 14 from the plane of blade 16, handle 30 may be turned to move surface 14 to the proper position for the desired thickness of the slices.

The food on tray 104 is sliced by placing the left hand on top of channel 132 and pressing inwardly against panel 128 with the hand in order to maintain the food against guide surface 14. At the same time, plate 108 is pushed toward blade 16 with the thumb in order to slide the food tray toward the blade. Plate 108 pushes the food against blade 16 to slice the food, and the slices drop out the back of the unit and down surface 42 onto the food plate (not shown) which is positioned in opening 44. Leftward movement of food tray 104 during the slicing stroke is limited by engagement of the left end of lip 114 with the left end of slot 110. After each slicing stroke is completed, food tray 104 is pulled back to the right end of platform 74 and food pusher 122 is pushed toward guide surface 14 prior to the beginning of another slicing stroke.

The thumb guard 138 is located adjacent the front side of housing 12 and passes closely adjacent the forward surface of blade 16 during the slicing stroke. The thumb guard thus prevents the thumb of the user from inadvertently slipping into the area of blade 16, and the extension of the thumb guard the entire height of housing 12 is important in this regard. Even if the thumb should slip above the top edge of plate 108, flange 140 of the thumb guard prevents the thumb from encountering the slicing blade.

The blade guard 46, the slicing blade 16, the food pusher 122, the food tray 104, and the platform 74 can all be removed from the housing and may be cleaned separately, as indicated previously. The guide surface 14 and its supporting structure may also be removed from cam ring 18 for cleaning.

The food slicing machine may be folded up for storage to the compact position shown in FIG. 1. The food pusher 122 is removed from food tray 104 and is positioned with side panel 126 on top of housing panel 12*a* and with plate portion 128 of the food pusher located in the space 94 presented adjacent the front side of the housing. The bottom panel 124 of the food pusher is located outside of space 94 against the left end portion of housing 12. Prior to folding of platform 74, food tray 104 is moved completely to the right until the end of lip 114 reaches the right end of slot 110. The pusher plate 108 of the food tray is then located beyond the right end of housing 12. Thumb guard 138 is pivoted downwardly such that locking pin 152 is received in opening 160 to lock the thumb guard in its storage position in extension along the outer surface of plate 108. Platform 74 is then pivoted upwardly to the storage position.

A sliding lock 170 mounted on top of housing 12 may be pushed outwardly until a projecting tab 172 of the lock member is extended through an opening 174 formed through plate portion 108 of the food tray. The lock 170 thus maintains the unit in its storage position. Leg 96 is pivoted into recess 98 in the storage position of the unit. The front and back sides of the machine present substantially flat surfaces in the storage condition so that the machine may be stored with either side placed on a shelf or the like. In the storage position of the machine, table portion 106 of the food tray is located in space 94 between guide surface 14 and platform 74, while the pusher plate 108 of the food tray is located against the right side of housing 12.

The machine nay be unfolded to its operating position by sliding lock 170 in a direction to remove tab 172 from opening 174 and then pivoting platform 74 downwardly. The food pusher 122 is then installed on food tray 104, and thumb guard 138 is pivoted upwardly to the operating position. It is important to note that the end of box 144 projects beyond the corresponding end of plate 108 when the thumb guard 138 is in the storage position. Consequently, the end of box 144 contacts the side of housing 12 to prevent movement of food tray 104 toward blade 16 unless the thumb guard is first pivoted to the operating position. The safety of the machine is thus enhanced since it cannot be operated with the thumb guard in other than the proper operating position thereof.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described my invention, I claim:

1. A food slicing machine comprising:

a housing having a generally vertical guide surface;

a slicing blade mounted on the housing, the blade being rotatable to slice food directed against the blade;

an electric motor coupled to the slicing blade for rotating the blade with respect to the housing;

a platform coupled with the housing for pivotal movement between a folded storage position and a generally horizontal operating position;

a food tray mounted on the platform for sliding longitudinal movement along the platform, the food tray having a table portion for carrying food toward the slicing blade, and a food pusher mounted on the food tray for moving food against the slicing blade; the table portion being disposed between the platform and the guide surface, and at least a portion of the food pusher disposed between the platform and the housing when the platform is in the storage position; and a releasable lock on the housing for locking the platform in the storage position.

2. The invention of claim 1 further including means for preventing accidental operation of the electric motor when the platform is in the storage position.

3. A food slicing machine comprising:

a housing adapted to rest on a support surface and presenting on one side a generally vertical guide surface for guiding food to be sliced;

a slicing blade mounted on said housing adjacent said guide surface, said blade being operable to slice food directed against the blade;

a platform coupled with said housing for pivotal movement between an unfolded operating position wherein the platform is oriented generally horizontally in lateral projection from said one side of the housing, and a folded storage position wherein the platform is oriented generally vertically adjacent said one side of the housing;

a food tray mounted for movement along said platform toward and away from the slicing blade, said food tray including a table portion adapted to carry food to be sliced toward the slicing blade; and a pusher portion of said food tray projecting from said table portion to push the food thereon toward the slicing blade upon movement of said food tray toward said blade, said table portion being disposed between said platform and guide surface with said pusher portion located adjacent an end of the housing when said platform is in the storage position.

4. A machine as set forth in claim 3, including releasable lock means for locking said platform in the storage position.

5. A machine as set forth in claim 3, including a lock member on said housing engageable with said pusher portion of the food tray to releasably lock said platform in the storage position.

6. A machine as set forth in claim 3, including a lock member mounted on said housing for sliding movement between a locking position and a release position, and an opening in said pusher portion receiving said lock member in the locking position thereof to lock said platform in the storage position.

7. A machine as set forth in claim 3, including:

a food pusher mounted on said food tray for movement thereon toward and away from said guide surface to maintain the food on said table portion against said guide surface; and means for storing said food pusher with a portion thereof disposed between said platform and housing in the storage position of said platform.

8. A machine as set forth in claim 3, including:

a pin member projecting from said platform into an opening presented in said housing to mount said platform to said housing for pivotal movement between the operating and storage positions;

yieldable means for biasing said pin member in a direction to enter said opening; and a knob coupled with said pin member and accessible to pull the pin member out of said opening to thereby separate said platform from the housing.

9. A machine as set forth in claim 8, wherein said knob comprises a plate carried on an outer end of said pin member and fitting against an end surface of said platform in a substantially flush fit therewith.

10. A machine as set forth in claim 9, including a portion of said plate projecting below said platform and surface and adapted to be gripped by a finger to facilitate pulling the pin member out of said opening.

11. A machine as set forth in claim 3, including:

a groove in said platform extending in the direction of movement of said food tray thereon; and a lip portion of said food tray fitting in said groove to guide said food tray along the platform, said lip portion being removable from said groove to permit separation of said food tray from said platform.

12. A machine as set forth in claim 3, including a thumb guard mounted to said food tray adjacent said one side of the housing and extending substantially the entire height of said one side to guard against the hand contacting said slicing blade upon movement of the food tray toward the blade.

13. A machine as set forth in claim 3, including a thumb guard mounted to said food tray for pivotal movement between an operating position wherein said thumb guard extends adjacent said one side of the housing to guard against the hand contacting said slicing blade upon movement of the food tray toward the blade, and a storage position wherein the thumb guard extends generally along said pusher portion of the food tray.

14. A machine as set forth in claim 13, including releasable means for locking said thumb guard in the operating position and in the storage position.

15. A machine as set forth in claim 13, including means preventing movement of said food tray toward the slicing blade when said thumb guard is in other than said operating position.

16. A machine as set forth in claim 13, including:

a first opening in said pusher portion of the food tray;

a pin member projecting from said thumb guard at a location to enter said first opening to releasably lock said thumb guard in the operating position;

yieldable means for biasing said pin member in a direction to enter said first opening; and a knob coupled with said pin member and adapted to be gripped to remove the pin member from the first opening, thereby permitting movement of said thumb guard from the operating position.

17. A machine as set forth in claim 16, including a second opening in said pusher portion located to receive the pin member to releasably lock the thumb guard in the storage position.

18. A machine as set forth in claim 17, including an arcuate groove in said pusher portion extending between said first and second openings to receive an end of said pin member during movement of said thumb guard between the operating and storage positions.

19. A machine as set forth in claim 13, wherein said thumb guard includes a portion which projects beyond said pusher portion of the food tray in the storage position of the thumb guard, said projecting portion contacting said housing to prevent movement of the food tray toward said slicing blade when said thumb guard is in the storage position.

20. A machine as set forth in claim 3, including:

an upper edge of said pusher portion of the food tray;

a groove in said pusher portion extending parallel to said upper edge in proximity thereto;

a food pusher for pushing food on said table portion of the food tray against said guide surface, said food pusher having a channel thereon fitting with said upper edge of the pusher portion in a manner to mount the food pusher on said food tray for movement generally along said table portion toward and away from said guide surface; and a lip on said channel fitting in said groove to maintain said channel on the upper edge of said pusher portion, said lip being selectively removable from said groove to permit separation of said food pusher from the food tray.

21. A machine as set forth in claim 20, wherein:

a space is presented between said platform and said one side of the housing in the storage position of the platform;

said table portion of the food tray is disposed in said space when the platform is in the storage position; and said food pusher is adapted to fit partially in said space when the platform is in the storage position.

22. A food slicing machine comprising:

a housing having one side presenting a generally vertical guide surface for guiding food to be sliced, a slicing blade mounted on said housing adjacent said guide surface and operable to slice food directed along said guide surface against the blade;

a platform coupled with said housing for pivotal movement between an unfolded operating position wherein the platform projects laterally from said one side of the housing in a generally horizontal orientation, and a folded storage position wherein the platform is spaced from said one side of the housing in a generally vertical orientation to present a space between the platform and said one side of the housing;

a food tray mounted for movement along said platform toward and away from the slicing blade to direct food on said tray toward said blade, said food tray being disposed partially in said space when said platform is in the storage position; and a food pusher mounted on said food tray for movement toward and away from said guide surface to maintain the food on said tray against the guide surface, said food pusher being removable from said food tray and having a plate portion adapted to fit in said space for storage when said platform is in the storage position.

23. A machine as set forth in claim 22, wherein said food tray includes:

a table portion overlying said platform in the operating position and presenting an upper surface adapted to carry food toward said slicing blade upon movement of said food tray toward the blade, said table portion being disposed in said space when said platform is in the storage position; and a pusher portion projecting from said table portion and adapted to push food on said table portion toward the slicing blade upon movement of said food tray toward the blade, said pusher portion being disposed out of said space and adjacent the housing when said platform is in the storage position.

24. A food slicing machine comprising:

a housing adapted to rest on a support surface, having on one side a generally vertical guide surface;

a slicing blade rotatably mounted on the housing adjacent the slot for slicing food directed against the blade;

a platform pivotably and removably mounted to the housing, the platform movable between a generally vertical platform storage position and a generally horizontal platform operating position;

a food tray slidingly mounted on the platform for longitudinal movement with respect to the slicing blade and defining a guide surface for a food pusher;

a food pusher slidably supported on the food tray to move food toward the blade;

a thumb guard mounted to the food table for pivotable movement between a guard storage position in which the thumb guard extends generally horizontally along the food tray and a guard operating position in which the thumb guard extends in a generally vertical position adjacent the guide surface, the food table disposed between the platform and the guide surface, and at least a portion of the pusher disposed between the platform and the housing when the platform is in the platform storage position.

25. The invention of claim 24 further including means for preventing movement of the food tray toward the slicing blade when the thumb guard is in other than the guard operating position.

26. The invention of claim 24 wherein a projecting portion of the thumb guard extends beyond the food tray in the guard storage position and cooperates with the housing to prevent movement of the food tray toward the slicing blade.

27. The invention of claim 24, including releasable means for selectively locking said thumb guard in the guard operating position and in the guard storage position.

28. The invention of claim 24, including:

a pin member projecting from said thumb guard;

a first opening in said food tray located to receive said pin member when the thumb guard is in the guard operating position, thereby releasing locking said thumb guard in the guard operating position;

yieldable means for biasing said pin member in a direction to enter said first opening; and a knob on said pin member accessible for gripping to remove said pin member from said first opening to permit movement of the thumb guard to said guard storage position.

29. The invention of claim 28, including a second opening in said food tray spaced from said first opening at a location to receive said pin member when the thumb guard is in the guard storage position, thereby releasably locking the thumb guard in the guard storage position.

30. A food slicing machine comprising:

a housing having a generally vertical face, a base for supporting the housing, a slicing disk mounted adjacent said face, an electric motor coupled to the slicing blade for rotating the slicing blade with respect to the face, said face and slicing disk defining an arcuate slot adjacent the slicing disk for conveying sliced food away from the slicing disk;

a platform which defines a longitudinal slot along an outer edge;

means for releasably mounting the platform to the housing such that the platfom is pivotable between a generally horizontal platform operating position and a generally vertical platform storage position adjacent the face;

a food table mounted for longitudinal movement with respect to the slicing blade, said table including a first flange on a first side of the table and a second flange on a second side of the table for slidably engaging the longitudinal slot and an inner edge of the platform, the food table defining a guide surface for receiving a food pusher;

a thumb guard connected to the food table adjacent to said face, pivotable between a guard storage position in which the thumb guard is generally parallel to the food table and a guard operating position in which the thumb guard is generally normal to the food table, the thumb guard also including a flange for preventing sliding movement of the food table when the thumb guard is in other than the guard operating position;

a food pusher slidingly mounted on the food table for guiding food toward the face;

a switch for energizing the motor;

a releasable lock on the housing engageable with the platform for retaining the platform in the platform storage position; the platform, the housing, the food table and the pusher configured such that when the platform is in the platform storage position, at least a part of the food table is located between the platform and the housing, at least a part of the pusher covers the switch, and at least another part of the pusher is positioned between the platform and the housing adjacent the food table.

* * * * *

UNITED STATES PATENT AND TRADEMARK OFFICE

CERTIFICATE OF CORRECTION

PATENT NO. : 4,345,498

DATED : Aug. 24, 1982

INVENTOR(S) : Gary R. Best

It is certified that error appears in the above—identified patent and that said Letters Patent is hereby corrected as shown below:

Column 4, line 29, delete "tube" and insert therefor --tab--.

Column 5, line 36, after the word "opening", insert the word --in--.

Column 6, line 27, delete "from" and insert therefor --that--.

Column 9, line 24, delete "nay" and insert therefor --may--.

Column 13, line 8, delete "tray" and insert therefor --table--.

Column 13, line 42, delete "releasing" and insert therefor --releasably--.

Signed and Sealed this

Twenty-eighth Day of June 1983

[SEAL]

Attest:

GERALD J. MOSSINGHOFF

Attesting Officer

Commissioner of Patents and Trademarks